US007263800B2

(12) United States Patent
Taddeo et al.

(10) Patent No.: US 7,263,800 B2
(45) Date of Patent: Sep. 4, 2007

(54) FLOWER WEB FOR ARRANGING PLANTS

(76) Inventors: Robert Taddeo, 12 Cauldwell St., Eastchester, NY (US) 10709; John Antonelli, 5 Pine Cir., Eastchester, NY (US) 10709

( * ) Notice: Subject to any disclaimer, the term of this patent is extended or adjusted under 35 U.S.C. 154(b) by 0 days.

(21) Appl. No.: 11/237,882

(22) Filed: Sep. 29, 2005

(65) Prior Publication Data

US 2006/0096171 A1 May 11, 2006

Related U.S. Application Data

(60) Provisional application No. 60/621,531, filed on Oct. 25, 2004.

(51) Int. Cl.
*A47G 7/03* (2006.01)

(52) U.S. Cl. ..... 47/41.11

(58) Field of Classification Search ..... 47/41.13, 47/41.01, 41.11, 41.12; D11/143, 152, 153; 248/27.8; 428/23, 27
See application file for complete search history.

(56) References Cited

U.S. PATENT DOCUMENTS

| | | | | |
|---|---|---|---|---|
| 1,462,947 | A | 7/1923 | Stuck | |
| 1,491,926 | A | 4/1924 | Rosenwald | |
| 1,527,856 | A * | 2/1925 | France | 47/41.11 |
| 1,918,785 | A | 7/1933 | Rosenwald | |
| 1,973,868 | A | 9/1934 | Field | |
| 2,005,966 | A | 6/1935 | Beagle | |
| 2,496,758 | A | 2/1950 | Tingley | |
| 2,637,143 | A | 5/1953 | Reynolds et al. | |
| D194,506 | S | 2/1963 | Laan | |
| D198,040 | S | 4/1964 | Bonham et al. | |
| 3,284,039 | A * | 11/1966 | Brunner | 248/153 |
| 3,447,262 | A | 6/1969 | Uhl | |

(Continued)

FOREIGN PATENT DOCUMENTS

| | | |
|---|---|---|
| GB | 304897 | 1/1929 |

(Continued)

OTHER PUBLICATIONS

"Flower Arranger—The Mariners' Museum Shop," website: http://shop.store.yahoo.com/marinersmuseum/flowerarranger.html, 1 page, printed from the Internet on Jul. 8, 2005.

(Continued)

*Primary Examiner*—Son T. Nguyen
(74) *Attorney, Agent, or Firm*—Christopher Wood; Wood & Eisenberg, PLLC

(57) ABSTRACT

A flower web for organizing flowers in a regular or irregularly shaped open top of a vase. The flower web includes inner and outer loops and a plurality of flower dividers. The inner and outer loops share a common center and a common horizontal plane. The plurality of flower dividers are of generally elongated appearance and are in contact with the inner loop and extend radially outward from the inner loop such that the flower dividers intersect and contact the outer loop to define a first plurality of apertures between the inner and outer loops. The plurality of flower dividers extend radially outward for a predetermined distance beyond the outer loop. The underside of the flower dividers is optionally at least partly coated with an adhesive coating. In another embodiment, a peelable strip covers the adhesive coating.

1 Claim, 9 Drawing Sheets

U.S. PATENT DOCUMENTS

| | | | | |
|---|---|---|---|---|
| 3,630,811 | A * | 12/1971 | Radus | 206/423 |
| D249,660 | S | 9/1978 | Meyer | |
| D297,823 | S | 9/1988 | Littlefield | |
| 5,127,184 | A | 7/1992 | Cosentino | |
| 5,347,752 | A | 9/1994 | Black | |
| 5,375,370 | A | 12/1994 | Zimmerman | |
| 5,443,670 | A * | 8/1995 | Landau | 156/191 |
| 5,477,637 | A | 12/1995 | Aldrich | |
| D368,675 | S | 4/1996 | Nix | |
| D380,172 | S | 6/1997 | Howell | |
| 5,758,452 | A | 6/1998 | Matteucci et al. | |
| 5,927,002 | A | 7/1999 | Walton et al. | |
| 6,189,261 | B1 | 2/2001 | Helgeson | |
| D446,749 | S | 8/2001 | Graves | |
| 6,523,301 | B2 | 2/2003 | Delaney | |
| D502,889 | S | 3/2005 | Broel | |
| 2002/0184818 | A1 | 12/2002 | Roskin | |
| 2003/0089033 | A1 | 5/2003 | Wimp, Jr. | |
| 2005/0138862 | A1 | 6/2005 | O'Connor | |

FOREIGN PATENT DOCUMENTS

| | | | |
|---|---|---|---|
| GB | 2 191 692 | A | 12/1987 |

OTHER PUBLICATIONS

"Flower Frogs," website: http://www.gardenscapetools.com/pages/indoorFrog.htm, 1 page, printed from the Internet on Jul. 8, 2005.

"Glass Vase, Flower Arranger," website: http://www.rubylane.com/shops/annibgardens/item/GV5030? froogle=1, 2 pages, printed from the Internet on Jul. 8, 2005.

* cited by examiner

FLOWER WEB FOR ARRANGING PLANTS

CROSS-REFERENCE TO RELATED APPLICATIONS

This application claims the benefit of priority from U.S. Provisional Patent Application Ser. No. 60/621,531, filed Oct. 25, 2004, the entire contents of which are incorporated herein by reference.

STATEMENT REGARDING FEDERALLY SPONSORED RESEARCH OR DEVELOPMENT

Not Applicable.

FIELD OF THE INVENTION

This invention relates to a flower web for engaging and covering a regular or irregularly shaped opening of an open container such as a vase.

BACKGROUND OF THE INVENTION

Time is a valuable asset and anything that can improve the utilization of time in an ethical and cost effective manner is of benefit to mankind. The traditional way of floral arranging, i.e. arranging plants or flowers in a container such as a flower vase, involves skill and dexterity. Not everyone can quickly and effortlessly arrange flowers in a flower vase. Some people suffer from arthritis and/or neurological disorders that make it difficult and/or uncomfortable to arrange flowers in a flower vase. Thus, there is a strong need for an apparatus or device that can assist in the arrangement of flowers in a container such as, but not limited to, a flower vase.

U.S. Publication No. 20020184818, published Dec. 12, 2002 to Linda Roskin, describes a device and method for preparing a vase or other container to receive a floral arrangement. The device includes a grid cover that is placed around the open end of a vase or similar container. The grid cover has a flat top surface and a peripheral wall that extends downwardly from the edge of the top surface. The grid cover is described as being made of elastomeric material and is said to be initially smaller than the open top of the vase. The grid cover is stretched over the open top of the vase, wherein the peripheral wall of the grid cover passes over the edge of the vase's open top and retains the stretched grid cover element in place. A plurality of openings is distributed throughout the top surface of the grid cover. As the grid cover is stretched over the top of a vase, the openings become positioned across the open top of the vase. Despite being made of elastomeric material, it is difficult to fit the Roskin '818 device tightly over irregularly shaped vase openings without leaving unwanted gaps.

U.S. Pat. No. 5,758,452, issued Jun. 2, 1998 to Matteucci et al., describes a floral arranging aid for holding flowers in a vase. The '452 device comprises a vase top cover of plastic or cardboard having a plurality of partially scored apertures that are opened by a flower stem. The apertures are arranged in rows and columns that are coded so that each aperture is located at a junction. The '452 device further comprises at least three tabs extending from the periphery of the '452 vase cover. The '452 device is not suitable for tight fitting over an irregularly shaped open top vase.

U.S. Pat. No. 2,637,143, issued to Reynolds et al., describes an adjustable frog in which the size of the openings for receiving the flowers is adjustable. The frog is a flower holder in which the supported articles may be firmly clamped in their relative positions. The frog may be used with a bowl or vase or independently of such receptacles. The frog is substantially three-dimensional in construction with a consequent impact on likely manufacturing costs.

None of the above inventions and patents, taken either singly or in combination, is seen to describe the instant invention as claimed.

SUMMARY OF THE INVENTION

A flower web for organizing flowers in a regular or irregularly shaped open top of a vase. The flower web includes inner and outer loops and a plurality of flower dividers. The inner and outer loops share a common center and a common horizontal plane. The plurality of flower dividers are of generally elongated appearance and are in contact with the inner loop and extend radially outward from the inner loop such that the flower dividers intersect and contact the outer loop to define a first plurality of apertures between the inner and outer loops. The plurality of flower dividers extend radially outward for a predetermined distance beyond the outer loop, wherein the flower dividers are at least partly made of a malleable material such that said flower dividers can be selectively bent to fit the flower web around a vase with a regular or irregularly shaped open top.

In another embodiment, the flower web includes flower dividers of general planar cross-section and an underside with an adhesive coating. An optional peelable strip can be used to cover the adhesive coating.

Figure 1:
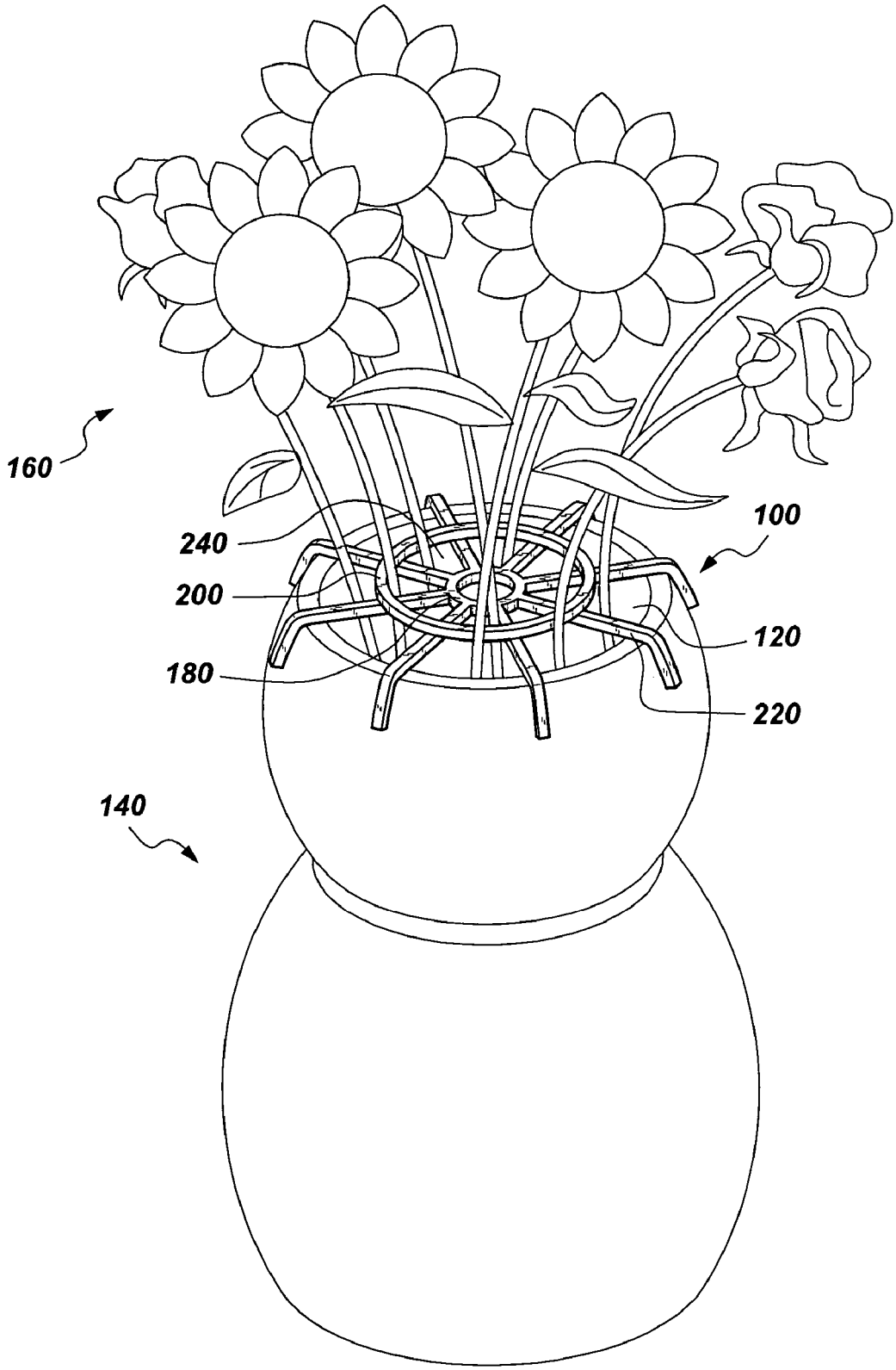
FIG. 1 is an environmental, perspective view of a flower web for organizing plants according to a first embodiment of the FIG. 2A shows a perspective view of the flower web of FIG. 1.

It should be understood that the attached figures are intended to be merely illustrative of the present invention and are not intended to limit the scope of the present invention in any way.

DETAILED DESCRIPTION OF THE INVENTION

This invention relates to a flower web 100 for engaging and covering a regular 120 (see, e.g., FIGS. 1 and 2A) or irregularly shaped opening 120*a* (see, e.g., FIG. 2B) of an open container, such as a vase 140 having an open side or perimeter 150. More specifically, the flower web of the present invention can be fitted over an irregular opening without leaving unwanted gaps.

The flower web 100 is intended for use in organizing or arranging plants 160. The terms "apparatus for organizing plants 100" and "flower web 100" are hereinafter regarded as equivalent terms. The term "flowers" is intended in a liberal sense and is intended to cover flowering and non-flowering plants, both natural and artificial plants (i.e., man made flowering or non-flowering plants).

Figure 2A:
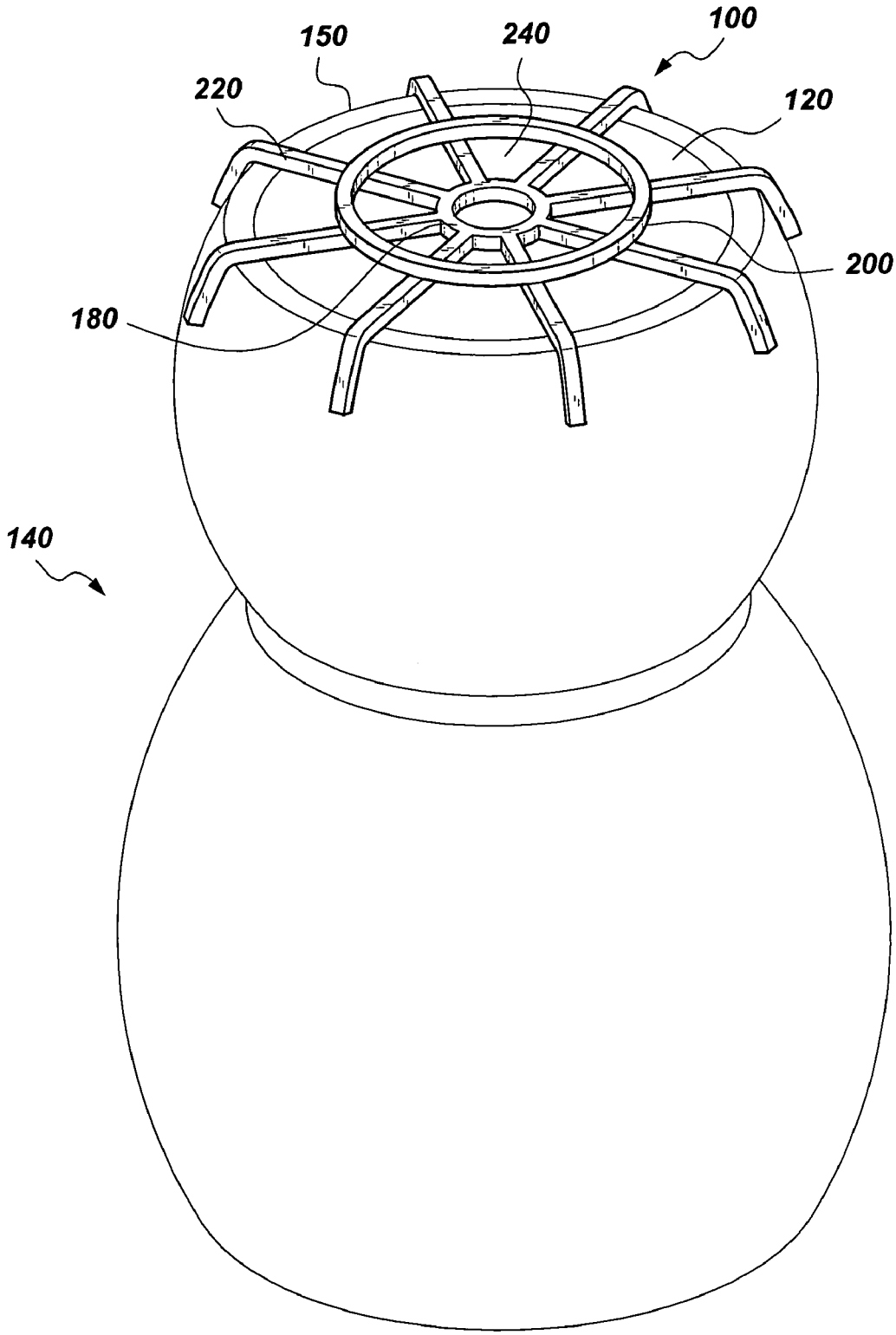
FIG. 2B shows a perspective view of the flower web of FIG. 1, but fitted around an irregularly shaped open top of a vase.
Figure 2B:
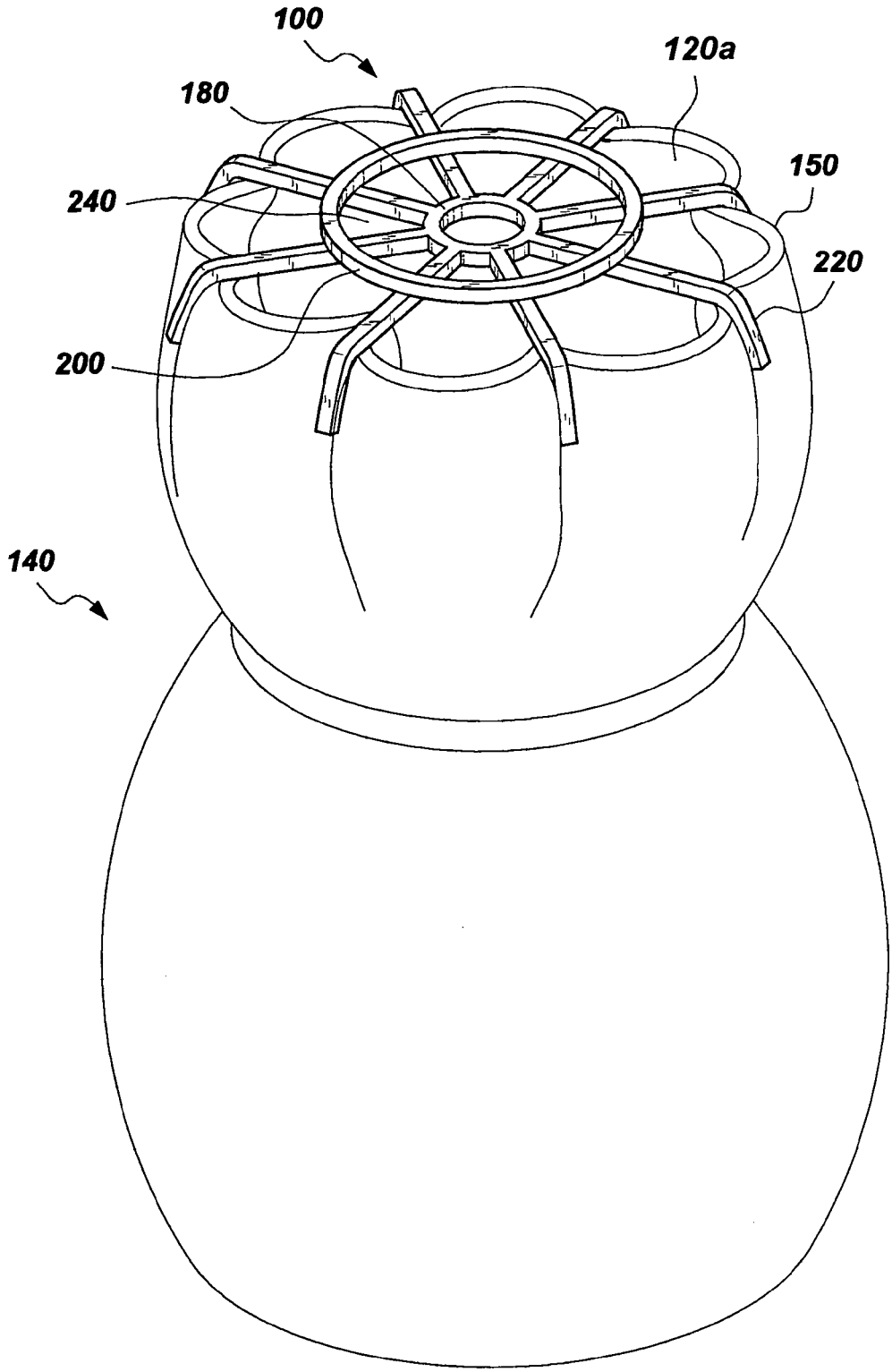
Figure 3:
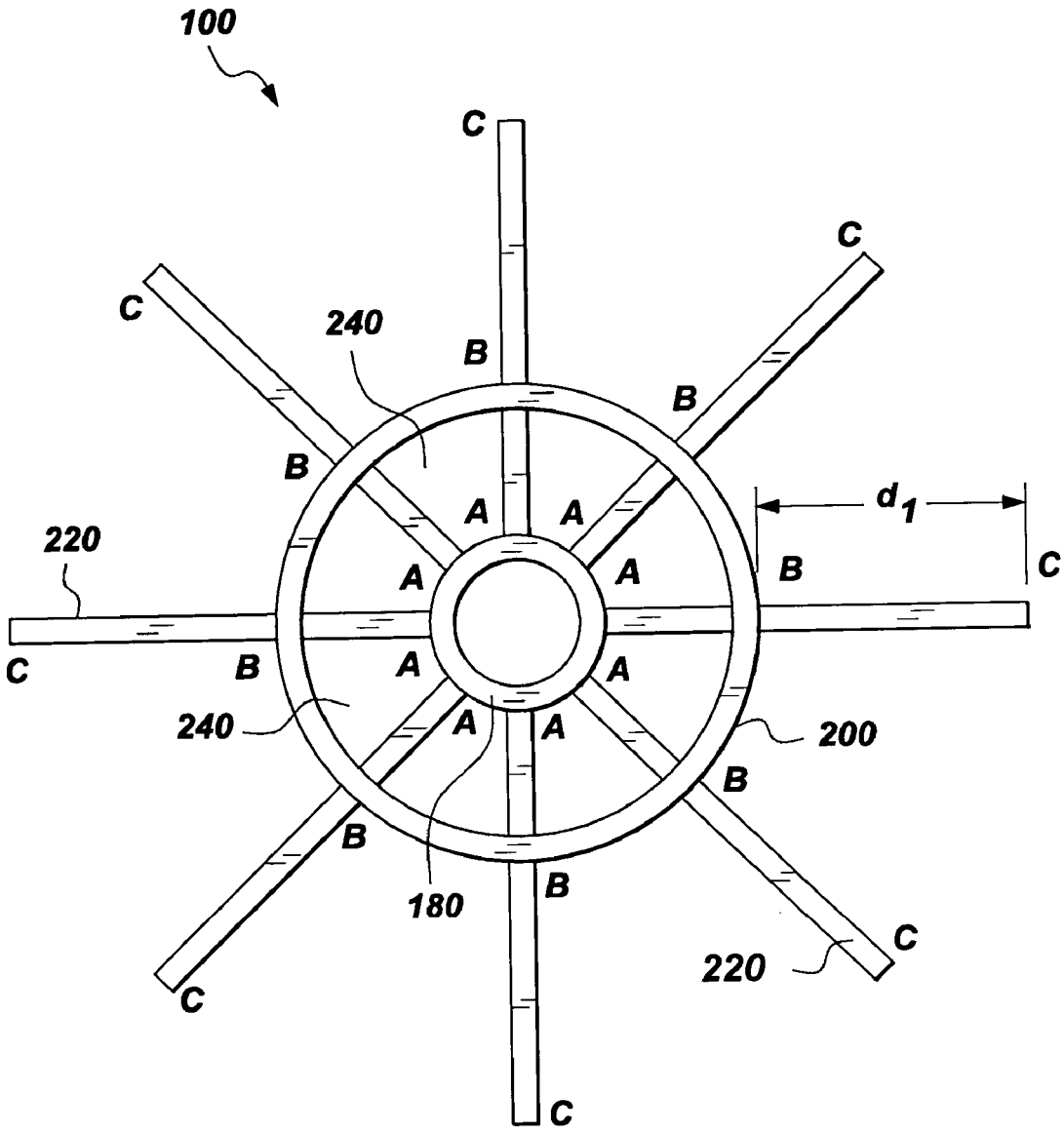
FIG. 3 shows a top view of the flower web of FIG. 1.

Referring to FIGS. 1 and 2A, FIG. 1 shows an environmental perspective view of a flower web 100 of the present invention. FIG. 2A shows a perspective view of the flower web 100 of FIG. 1 fitted over the open top 120 of a vase 140. The flower web 100 comprises inner and outer loops 180 and 200, and a plurality of flower dividers 220. The inner and outer loops 180 and 200 share a common center and horizontal plane. The plurality of flower dividers 220 are of generally elongated appearance. The parts 180, 200 and 220 can be made of any suitable material such as plastic, metal strips, and/or plastic coated metal strips, alone or in combination. The inner and outer loops 180 and 200 are sufficiently resilient to confer an element of structural stability to the flower web 100 such that the substance of the flower web 100 maintains a common horizontal plane up until the ends C (see FIG. 3) of the flower dividers 220 are bent over, the sides or perimeter 150 of an open top vase 140.

Figure 4:
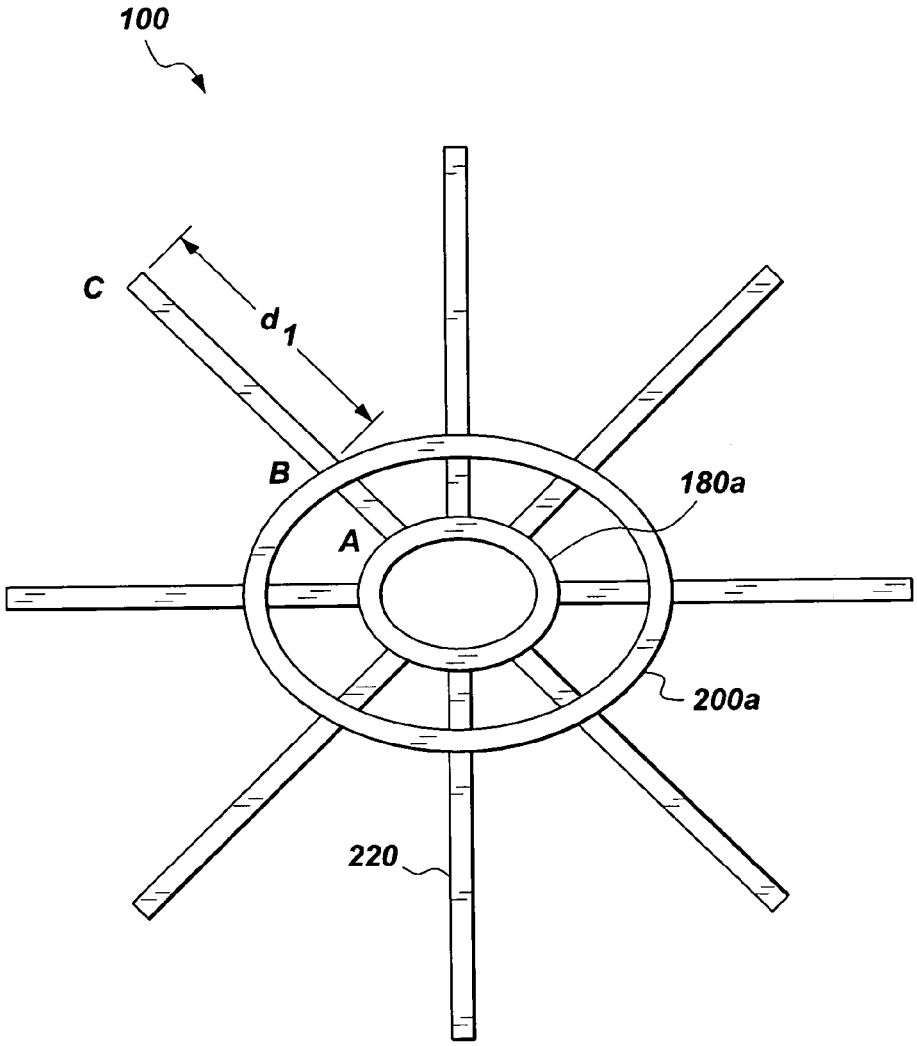
FIG. 4 shows a top view of a flower web according to the present invention.
Figure 7:
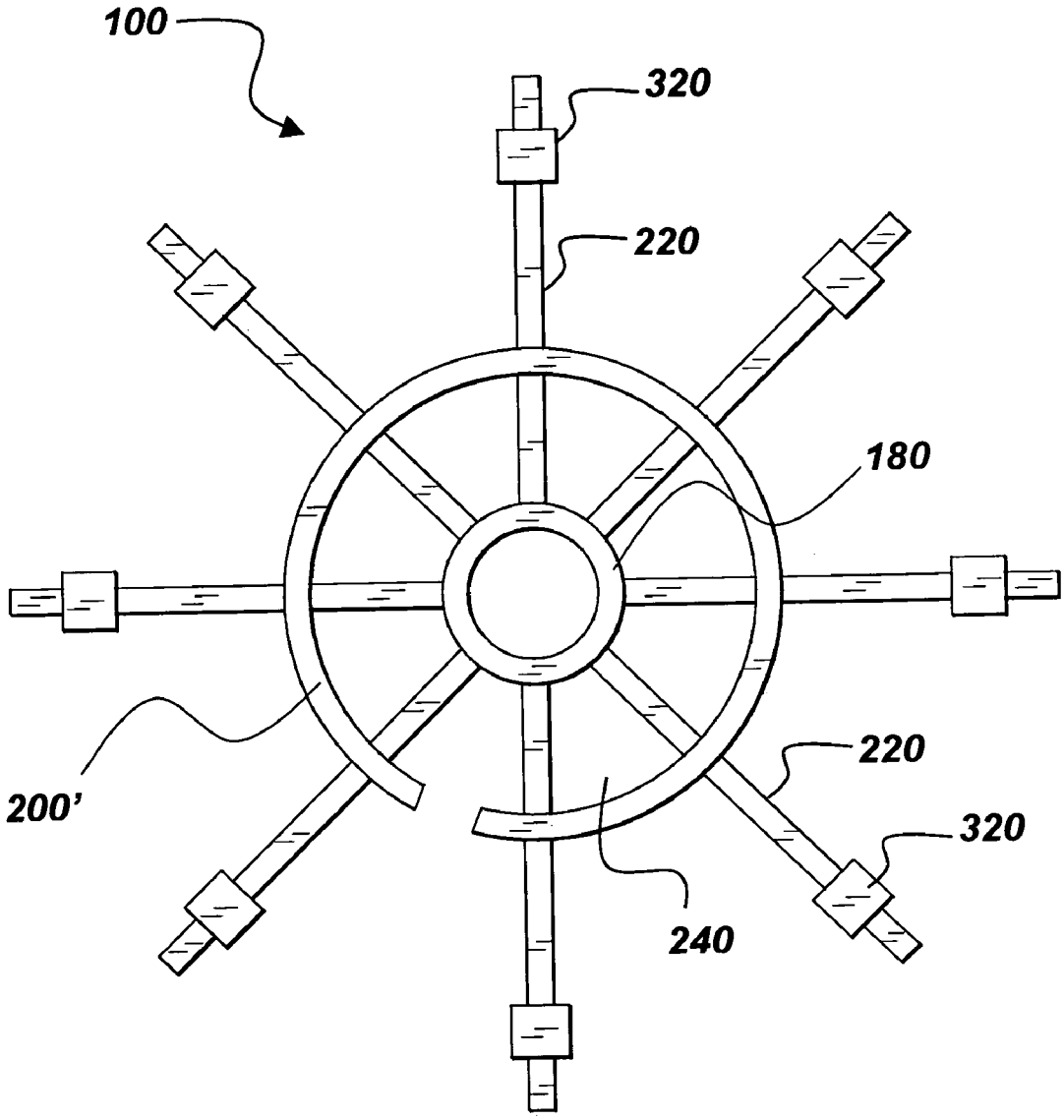
FIG. 7 shows a flower web according to the invention.

It should be understood that the inner and outer loops 180 and 200 can adopt any suitable concentric configuration such as, but not limited to: concentric circles, concentric ovals, concentric squares, concentric rectangles, and regular or irregular concentric polygons. Examples of inner, and outer loops 180 and 200 configured as concentric polygons include, but are not limited to: regular or irregular pentagonal, hexagonal, heptagonal, or octagonal concentric inner and outer loops. Concentric inner and outer loops in the form of concentric inner and outer oval shaped loops 180*a* and 200*a* are shown in FIG. 4. It should also be understood that the inner and outer loops 180 and 200 might be discontinuous or endless loops. Endless inner and outer concentric loops 180 and 200 are shown, e.g., in FIGS. 2A through 4. A discontinuous outer loop 200' is shown in FIG. 7. Still further, though only an inner 180 loop and an outer loop 200 are shown, there is no limitation on adding additional loops, the additional loops may or may not be concentric with respect to the inner and outer loops 180 and 200. More specifically, the phrase "comprises inner and outer loops 180 and 200" explicitly means additional concentric or non-concentric loops (not shown) are not excluded.

Still referring to FIGS. 1 and 2A, each of the plurality of flower dividers 220 are in contact with the inner loop 180 and extend radially outwards therefrom such that the flower dividers 220 intersect and contact the outer loop 200 to define a first plurality of apertures 240 located between the inner and outer loops 180 and 200. The flower dividers 220 extend radially outward for a predetermined distance beyond the outer loop 200.

Figure 6A:
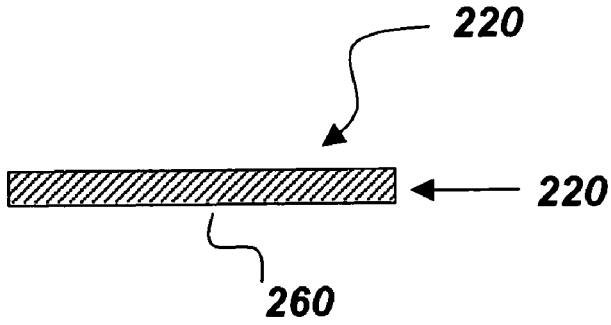
FIG. 6A shows an end view of a flower divider according to the invention.

The flower dividers 220 are at least partly made of a malleable material such that the flower dividers 220 can be selectively bent by hand, e.g., by the hands of a flower shop worker (not shown), to fit the flower web 100 around a regular or irregularly shaped open top 120 of a flower container such as a vase 140. FIG. 6A shows an end view of one of the flower dividers 220 of FIG. 3, wherein the flower dividers 220 have an underside surface 260.

Figure 6B:
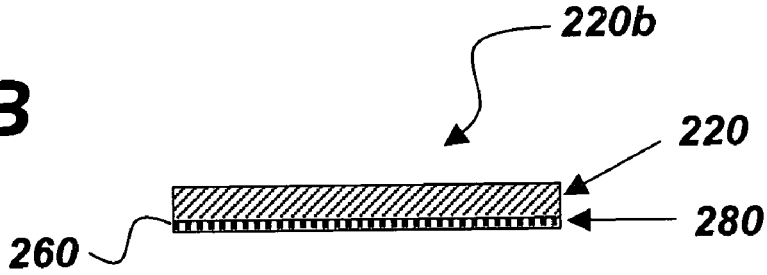
FIG. 6B shows an end view of another flower divider according to the invention.

FIG. 6B shows another embodiment in which the flower dividers 220 (represented by alphanumeric label "220*b*") are of general planar cross-section and have an underside 260 with an adhesive coating 280. The adhesive coating 280 can be applied at particular points or anywhere along the underside 260. For example, an adhesive coating 280 might be added to the underside 260 between points B and C (see FIG. 3). In more detail, each of the flower dividers 220 respectively connect to the inner and outer loops 180 and 200 at points A and B and the flower dividers 220 terminate at point C, i.e., at a predetermined distance $d_1$ beyond point B, where B represents the intersection point (i.e., contact between parts 220 and 200). The adhesive coating 280 is attached to the underside 260 between intersection point B and the end of each web divider at C. It should be understood that the adhesive coating 280 can be applied anywhere along the underside 260 and is not restricted to the underside between points B and C. The adhesive coating 280 might be applied to the underside 260 of just some, and not all, of the flower dividers 220.

Figure 6C:
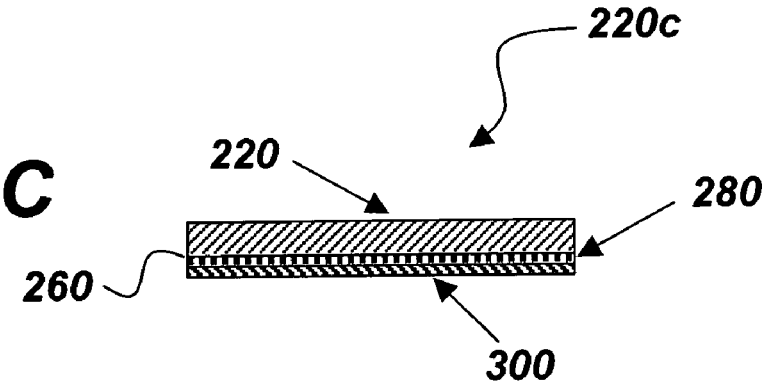
FIG. 6C shows an end view of a further flower divider according to the invention.

In another embodiment, the flower web 100 includes flower dividers 220 of general planar cross-section and an underside 260 with an adhesive coating 280. A peelable strip 300 optionally covers the adhesive coating 280. FIG. 6C shows an end view of a flower divider 220 (represented by alphanumeric label "220*c*") comprising an adhesive coating 280 covered in turn with a peelable strip 300. The peelable strip 300 serves to prevent accidental adhesion of the flower web 100 to unwanted objects or surfaces.

Figure 5A:
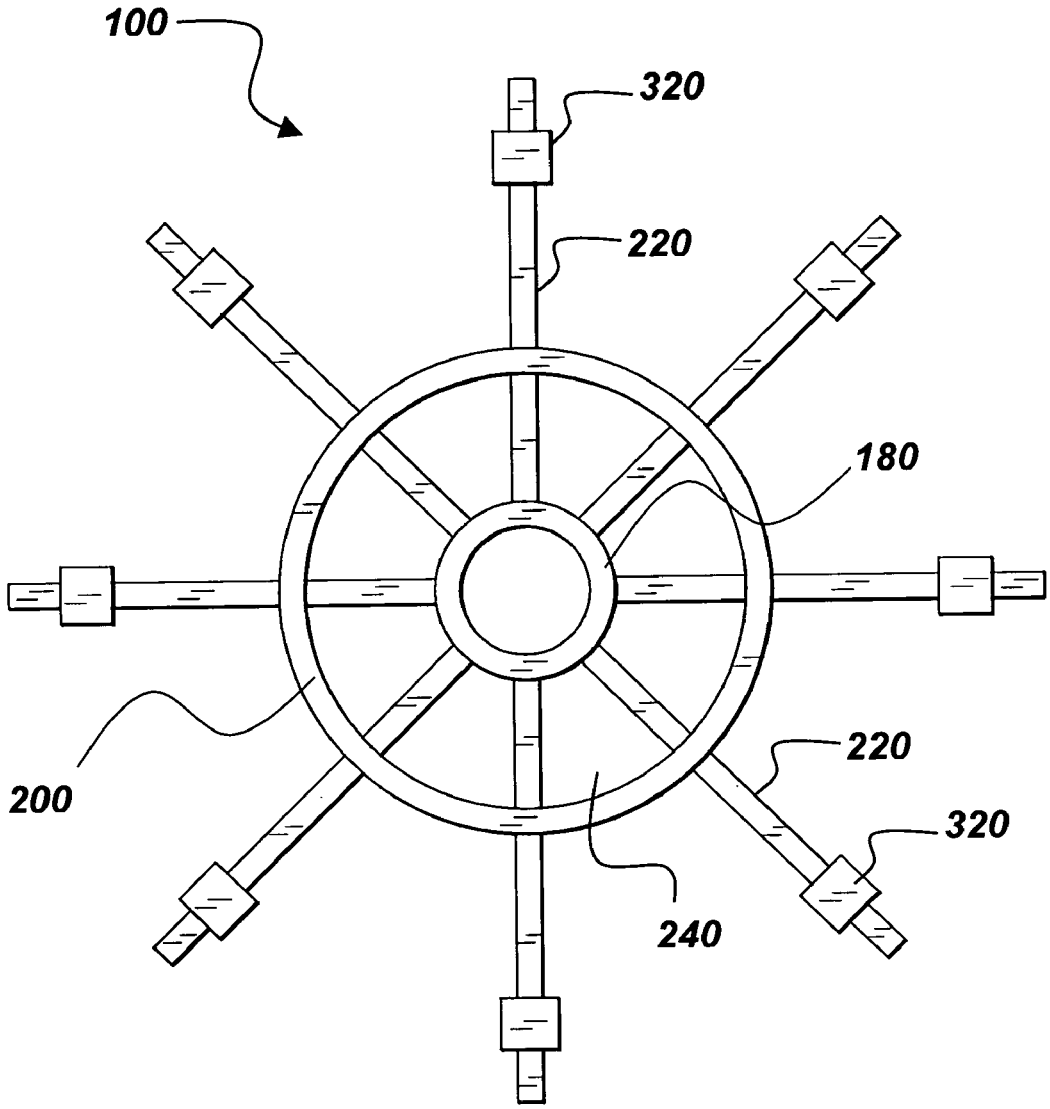
FIG. 5A shows a top view of a flower web fitted with moveable clamps according to the invention.
Figure 5B:
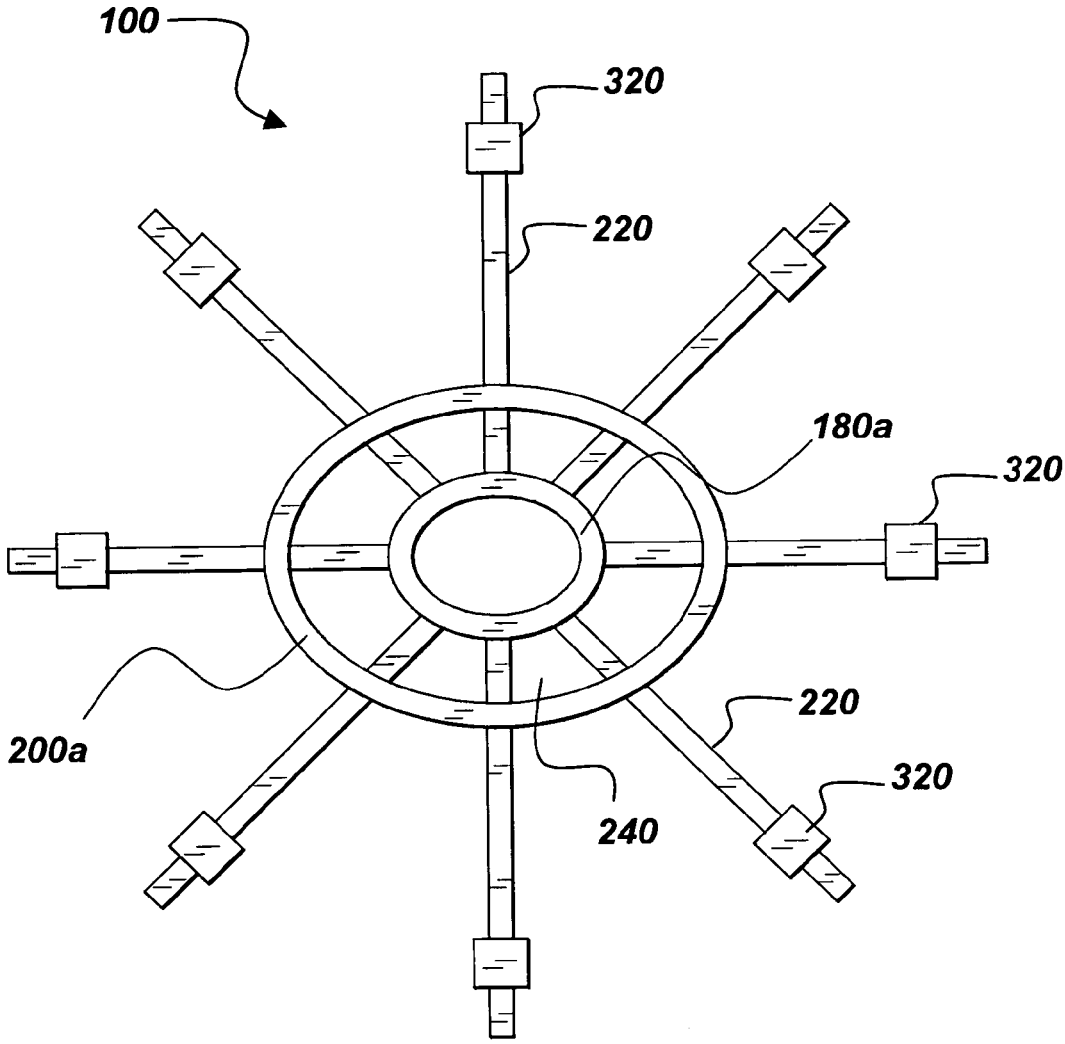
FIG. 5B shows a top view of a flower web fitted with moveable clamps according to the invention.

In a further non-limiting embodiment, the flower web 100 includes moveable clips 320 (see FIGS. 5A and 5B) that are fitted to at least one of the flower dividers 220. The moveable clips 320 slide reversibly along the at least one flower divider 220 and are used to attach ends C of the at least one flower divider 220 to the perimeter 150 (shown in, e.g., FIG. 2A) of a regular or irregularly shaped opening 120 of an open top container such as a flower vase 140.

It is to be understood that the present invention is not limited to the embodiments described above, but encompasses any and all embodiments within the scope of the following claims.

We claim:

1. A flower web for organizing flowers in a container, the container having a perimeter around a regular or irregularly shaped open top, said flower web consisting of:

inner and outer loops, wherein said inner and outer loops share a common center and a common horizontal plane; and a plurality of flower dividers of generally elongated appearance, wherein each of said plurality of flower dividers extend radially outward from said inner loop such that said flower dividers intersect and contact said outer loop to define a first plurality of apertures between said inner and outer loops, wherein said flower dividers do not extend inwardly beyond said inner loop, wherein said plurality of flower dividers extend radially outward for a predetermined distance beyond said outer loop, wherein said flower dividers are at least partly made of a malleable material such that said flower dividers can be selectively bent over a perimeter of a regular or irregularly shaped open top, and wherein said flower dividers have an undersurface at least partly coated with an adhesive coating and a peelable strip covering said adhesive coating.

* * * * *